US005738587A

United States Patent [19]

Dykstra

[11] Patent Number: 5,738,587

[45] Date of Patent: Apr. 14, 1998

[54] MACHINE FOR PRODUCING OPTICAL ILLUSIONS

[76] Inventor: Frank Dykstra, 231 Cherokee Dr., Apt. 15, Beaver Dam, Wis. 53916

[21] Appl. No.: 695,935

[22] Filed: Aug. 12, 1996

[51] Int. Cl.[6] ..... A63G 31/00

[52] U.S. Cl. ..... 472/61; 472/72; 40/427

[58] Field of Search ..... 472/61, 72, 57; 40/427, 429, 430, 431, 433, 456

[56] References Cited

U.S. PATENT DOCUMENTS

| | | | |
|---|---|---|---|
| 2,822,725 | 2/1958 | Recht | 40/456 X |
| 2,891,338 | 6/1959 | Palamara | 40/433 |
| 4,085,932 | 4/1978 | Hamano | 472/61 |
| 5,205,636 | 4/1993 | Carpenter | 472/61 X |
| 5,448,455 | 9/1995 | Ryan | 40/433 X |

*Primary Examiner*—Kien T. Nguyen
*Attorney, Agent, or Firm*—Donald Cayen

[57] ABSTRACT

A motor is secured in the interior of an enclosed housing. The motor shaft extends outside of the housing. A turntable is connected to the motor shaft on the outside of the housing. The turntable is located in a recess in the housing. An illusionary disk is held on the turntable. A potentiometer controls the speed of the motor and thus the speed of the turntable to produce different optical illusions from the illusionary disk. A light is located in the housing near the turntable. The light flashes through openings in the illusionary disk to produce additional optical illusions as the illusionary disk rotates.

6 Claims, 1 Drawing Sheet

MACHINE FOR PRODUCING OPTICAL ILLUSIONS

BACKGROUND OF THE INVENTION

1. Field of the invention

This invention pertains to amusement devices, and more particularly to apparatus and methods for creating multiple illusionary effects.

2. Description of the Prior Art

It is well known that many objects present a different visual pattern when the object is rotating then when the object is stationary. Lines, spots, and other shapes on the object lose their initial appearance and acquire new shapes when the object is rotated. The new shapes themselves can vary with different rotational speeds. Even objects displaying crude or simple patterns can present interesting and even startling patterns when rotated at different speeds.

Many people are aware that a disk displaying multiple colors when at rest will appear to be white when the disk is rotated at high speed. Not so well known is the fact that disks having only certain black and white patterns can show colors, such as brown and purple, when the disk rotates at the proper speed. A strobe light directed onto a spinning disk also can produce surprising illusions. Three-dimensional disks of different shapes and colors produce enhanced illusions. Blowing through a straw at three-dimensional disks having either regular or irregular contours produces tones of varying pitches.

The Open Horizons Publishing Company of Fairfield, Iowa, publishes a collection of paper disks having different black and white patterns. The disks produce different illusionary effects when they are rotated.

A problem associated with the use of illusionary disks is the lack of suitable mechanisms for rotating them. For example, the Open Horizons Publishing Company recommends using a phonograph turntable as the rotating mechanism for its disks. However, phonograph turntables rotate at a maximum speed of only 78 revolutions per minute. That relatively slow speed greatly limits the effectiveness of illusionary disks. In addition, the constant speed of a phonograph turntable limits the range of illusionary effects producable from a disk. Phonograph turntables also lack a satisfactory way to hold an illusionary disk to it. The friction between the disk and the turntable is minimal, so the disk often slips on the turntable. The disk thus does not always produce a satisfactory illusionary effect. Other rotating mechanisms, such as electric hand drills, can rotate at much higher speeds than phonograph turntables. However, mounting a disk to a drill chuck is cumbersome and requires special holding components. Many, if not most, other commonly available high speed rotating mechanisms are also not suitable for use with paper disks. In addition, electrical drills and similar high speed rotating devices are not appropriate for use by children, who are the most frequent users of illusionary disks.

Thus, a need exists for a convenient way to rapidly rotate illusionary disks.

SUMMARY OF THE INVENTION

In accordance with the present invention, a machine for producing optical illusions from illusionary disks provides higher speeds and greater speed variations than was previously possible. This is accomplished by apparatus that includes a high speed variable speed turntable mounted to an enclosed housing.

The turntable is connected to a variable speed motor. The motor is preferably powered by dry cell batteries, although line voltage can also be used. A manually operated potentiometer in the motor circuit varies the motor speed.

The motor is secured to the interior of the housing with the turntable being on the outside of the housing. It is preferred that the turntable be located within a recess in the housing. The recess has a size slightly greater than the envelope of the illusionary disk. The turntable includes a spindle that guides and holds the illusionary disk. The spindle preferably is frusto-conical in shape, and its exterior surface is rough or textured.

In operation, the central hole of a desired illusionary disk is placed on the turntable spindle. The tapered and rough surface of the spindle helps grip the disk hole. By energizing the electric motor and varying its speed with the potentiometer, the disk is made to rotate to any speed that produces a desired optical illusion from the disk. Varying the motor speed varies the illusion produced by the disk, all to the amusement and satisfaction of the user.

Further in accordance with the present invention, a light is built into the housing recess adjacent the turntable periphery. The light may be controlled to glow independently of turntable rotation. If a rotating illusionary disk has openings in it, the light is seen to flash through the openings for added visual appeal.

The method and apparatus of the invention, using a variable and high speed turntable, thus enables multiple optical illusions to be produced in a very convenient way. The machine for producing the optical illusions is suitable for use by small children, even though the range of illusions that can be produced is very large.

Other advantages benefits, and features of the present invention will become apparent to those skilled in the art upon reading the detailed description of the invention.

DETAILED DESCRIPTION OF THE PREFERRED EMBODIMENT

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 1:
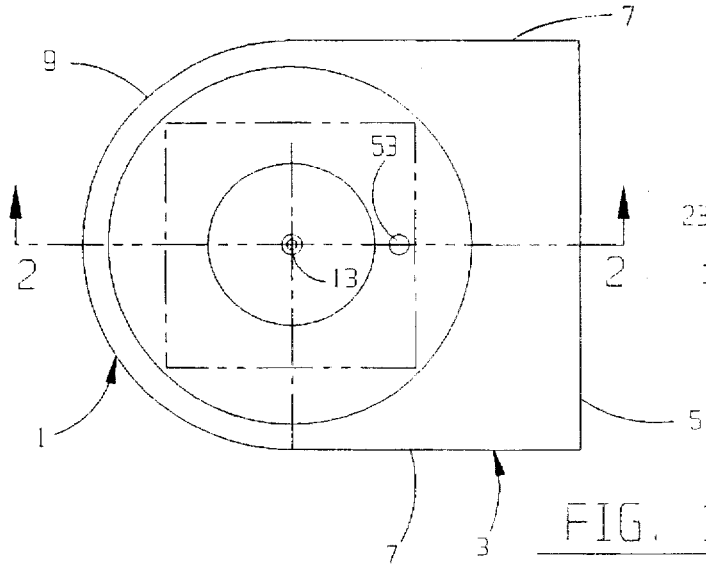
Fig. 1 is a top view of the machine for producing optical illusions according to the present invention.
Figure 2:
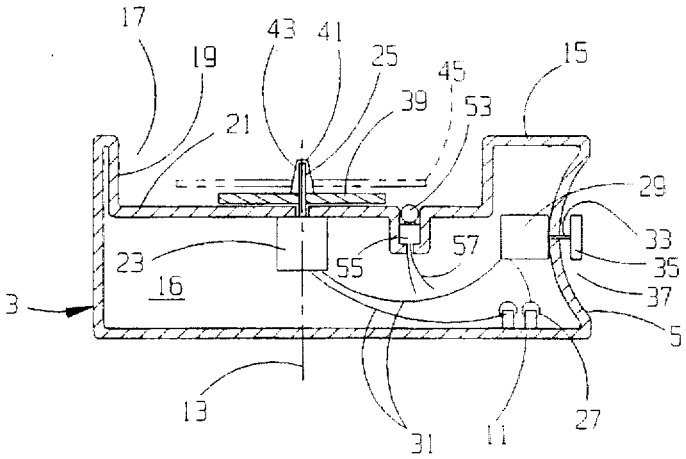
FIG. 2 is a cross sectional view taken along line 2—2 of FIG. 1.
Figure 3:
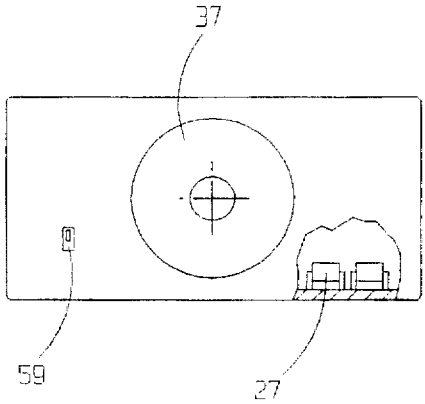
FIG. 3 is a side view of FIG. 2.

Referring to FIGS. 1–3, a machine 1 for producing optical illusions is illustrated that includes the present invention. The machine 1 is particularly useful for providing amusement for persons of all ages, but it will be understood that the invention is not limited to recreational purposes.

The machine 1 for producing optical illusions is comprised of a housing 3 that may have any suitable size and shape. The particular housing illustrated has a first end wall 5, two flat side walls 7, and a semi-circular second end wall 9. There is a bottom wall 11 lying in a plane perpendicular to the walls 5, 7, and 9. The semi-circular end wall defines a vertical centerline 13.

A top wall 15 is parallel to the bottom wall 11 and extends between the walls 5, 7, and 9. The walls 5, 7, 9, 11, and 15 cooperate to define an interior 16 of the housing 3. The top wall 15 has a circular recess 17 that is concentric with the centerline 13. The recess 17 is defined by an intermediate wall 21 that is parallel to the bottom wall, and by a circular outer wall 19 that connects between the top wall and the intermediate wall.

Figure 4:
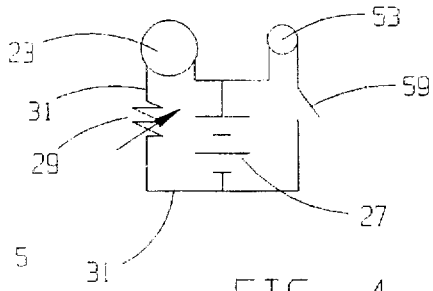
FIG. 4 is the schematic diagram of an electrical circuit according to the present invention.

Secured to the intermediate wall 21 in the interior 16 of the housing 3 is an electric motor 23. The motor armature shaft 25 extends through a small hole in the intermediate wall concentric with the centerline 13. In the preferred embodiment, the motor 23 is a variable speed six volt DC motor that is powered by conventional dry cells 27 arranged in series. Also see FIG. 4. To turn the motor on and off as well as to vary the motor speed, a potentiometer 29 is connected via wires 31 to the cells 27 and the motor. Although the potentiometer can be located at any convenient place on the housing 3, I prefer that it be attached to the first end wall 5 within the housing interior 16. The potentiometer shaft 33 protrudes through the first end wall. A hand knob 35 is assembled on the shaft 33. To provide both protection and accessibility to the knob 35, the first end wall has a concave area 37 in which the knob is located.

Connected to the armature shaft 25 of the motor 23 is a turntable 39. A spindle 41 is part of the turntable 39. The spindle 41 is frusto-conical in shape, and its tapered surface 43 has a rough texture. For example, the surface 43 may have longitudinally extending flutes. If desired, the spindle surface can be knurled rather than fluted.

Figure 5:
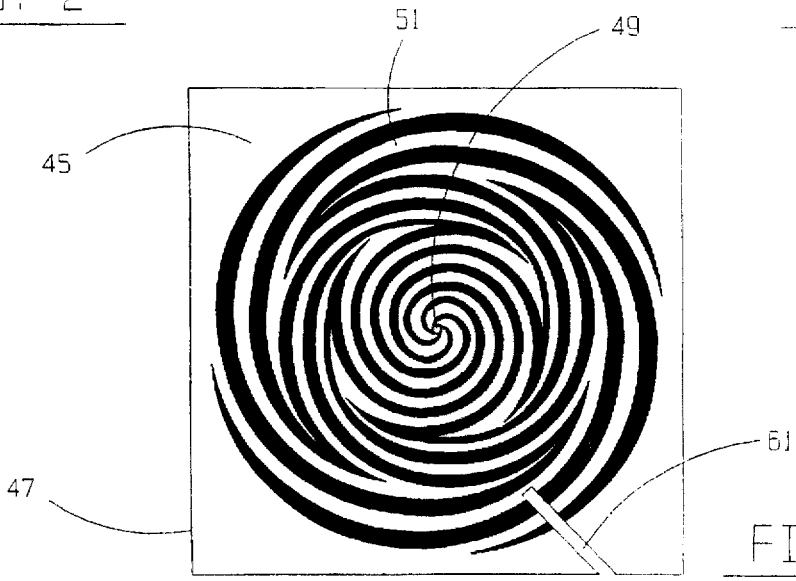
FIG. 5 is a top view of a typical illusionary disk suitable for use with the machine for producing optical illusions.

The machine 1 is used to produce optical illusions using illusionary disks. A typical illusionary disk 45 is depicted in FIG. 5. The illusionary disk 45 can be made from any suitable material; heavy paper is satisfactory. The illusionary disk has a periphery 47 that fits inside the recess 17 of the housing 3. At the center of the illusionary disk is a hole 49. imprinted on one or both faces of the disk is a pattern 51. Almost any conceivable pattern can be imprinted on the disks; the particular pattern 51 shown is merely representative.

The illusionary disk 45 is placed on the turntable 39 with the disk hole 49 fitting over the spindle 41. The spindle rough and textured surface 43 helps to grip the disk hole. For clarity, in FIG. 2 the disk is shown spaced from the turntable but in actuality the disk rests on the turntable. The knob 35 is turned to cause the cells 27 to energize the motor 23 and start the turntable and disk to rotate together. Varying the motor speed by turning the knob produces different optical illusions from a single disk.

Further in accordance with the present invention, a light 53 is incorporated into the machine 1. The light 53 is held in a socket 55 that in turn is built into the housing intermediate wall 21 near the periphery of the turntable 39. The light is connected via wires 57 to the cells 27 and to a switch 59. The light is used with an illusionary disk 45 having one or more slots 61 or other openings. The slots 61 are located to pass over the light when the disk is rotated. The intermittent flashes of light produced as the disk rotates provide further variations of the optical illusions seen by a person using the invention.

In summary, the results and advantages of illusionary disks can now be more fully realized. The machine 1 enables an almost limitless number of optical illusions to be produced in a convenient and economical manner. This desirable result comes from using the combined functions of the turntable 39 and the potentiometer 29. The turntable holds an illusionary disk for rotating therewith at any of a wide range of speeds as determined by the potentiometer. Any of a large variety of two-dimensional and three-dimensional illusionary disks can be rotated with the turntable. The light 53 adds to the variety of visual effects that can be produced.

It will also be recognized that in addition to the superior performance of the machine 1 for producing optical illusions, its construction is such as to be of very modest cost. Also, because it is simply and ruggedly constructed, it provides long service life with minimal maintenance.

Thus, it is apparent that there has been provided, in accordance with the invention, a machine for producing optical illusions that fully satisfies the aims and advantages set forth above. While the invention has been described in conjunction with specific embodiments thereof, it is evident that many alternatives, modifications, and variations will be apparent to those skilled in the art in light of the foregoing description. For example, line voltage can be used in place of the battery cells 27 to energize the motor. In that case, the motor is replaced by a variable speed AC motor, and the battery cells are replaced by a suitable cord, plug, and switch for using the line voltage. Accordingly, it is intended to embrace all such alternatives, modifications, and variations of the invention as fall within the spirit and broad scope of the appended claims.

I claim:

1. A machine for producing optical illusions comprising:

a. a housing comprising:

i. a first end wall;

ii. opposed side walls;

iii. a second end wall having a semi-circular shape that defines a longitudinal centerline; and iv. top and bottom walls parallel to each other and connecting the first and second end walls and the side walls, the housing top wall having a recess partially defined by an intermediate wall parallel to the top and bottom walls, the housing recess being circular in shape and having a centerline that is concentric with the longitudinal centerline of the housing second end wall;

b. a variable speed motor secured to the housing, the motor having a shaft, the motor shaft having a centerline that is concentric with the longitudinal centerline of the housing second end wall;

c. a turntable connected to the motor shaft the turntable having a periphery and located within the housing recess; and d. means for rotating the motor and turntable at a selected speed, so that an illusionary disk placed on the turntable and rotated therewith at the selected speed produces an optical illusion.

2. The machine of claim 1 further comprising a light in the recess intermediate wall outside of the turntable periphery, so that an illusionary disk having an opening therein outside of the turntable periphery cooperates with the light to produce light flashes through the illusionary disk opening when the turntable and illusionary disk are rotated and thereby produce further optical illusions.

3. The machine of claim 1 wherein:

a. the means for rotating the motor comprises a potentiometer attached to the housing first wall and a knob assembled to the potentiometer; and b. the housing first end wall has a concave area that provides protection and accessibility to the knob.

4. In combination with an illusionary disk having a circular hole therethrough, apparatus for rotating the illusionary disk comprising:

a. a housing having opposed first and second end walls, side walls, and top and bottom walls that cooperate to define a housing interior, the housing top wall having a recess that is partially defined by an intermediate wall parallel to the top wall, the housing second end wall being semi-circular in shape and defining a longitudinal centerline;

b. turntable means mounted to the housing top wall for holding the illusionary disk thereto, the turntable means comprising:

i. a variable speed electric motor in the interior of the housing and secured to the housing intermediate wall, the motor having a shaft that extends through the intermediate wall, the motor shaft and the housing recess having respective centerlines that are concentric with each other and with the longitudinal centerline of the housing second end wall and;

ii. a turntable connected to the housing shaft; and c. means for rotating the turntable means and the illusionary disk at variable speeds to thereby produce varying optical illusions from the illusionary disk.

5. The combination of claim 4 wherein the means for rotating the turntable means comprises:

a. a source of electric power;

b. a potentiometer in the interior of the housing and attached to the first end wall, the potentiometer having a shaft that extends through the first end wall;

c. a knob on the potentiometer shaft, wherein the housing first end wall is formed with a concave area that provides protection and access to the potentiometer knob; and d. circuit means for electrically connecting the source of electric power to the potentiometer and the electric motor, so that turning the potentiometer shaft with the knob causes the motor shaft and turntable to rotate at variable speeds.

6. The combination of claim 4 wherein the turntable means further comprises a spindle having a frusto-conical surface that contacts the hole in the illusionary disk, wherein the spindle is formed with a rough or textured surface that grips the hole in the illusionary disk.

* * * * *